US008792794B2

(12) United States Patent
Okuno

(10) Patent No.: US 8,792,794 B2
(45) Date of Patent: Jul. 29, 2014

(54) FIXING DEVICE AND IMAGE FORMING APPARATUS HAVING JAM DETECTION UNIT

(75) Inventor: Jinjyu Okuno, Toyohashi (JP)

(73) Assignee: Konica Minolta Business Technologies, Inc. (JP)

( * ) Notice: Subject to any disclaimer, the term of this patent is extended or adjusted under 35 U.S.C. 154(b) by 79 days.

(21) Appl. No.: 13/450,976

(22) Filed: Apr. 19, 2012

(65) Prior Publication Data

US 2012/0281994 A1 Nov. 8, 2012

(30) Foreign Application Priority Data

May 6, 2011 (JP) ..... 2011-103375

(51) Int. Cl.
*G03G 15/20* (2006.01)

(52) U.S. Cl.
CPC ..... *G03G 15/2028* (2013.01)
USPC ..... 399/21; 399/33; 399/67; 399/68; 399/69; 399/320; 399/321; 399/322; 399/323; 399/122; 271/309; 271/311; 271/176

(58) Field of Classification Search
CPC ..... G03G 15/2028; G03G 15/2085; G03G 15/70; G03G 2215/00548
USPC ..... 399/21, 33, 67–69, 122, 320–322, 323, 399/355, 305; 271/309, 311, 176
See application file for complete search history.

(56) References Cited

U.S. PATENT DOCUMENTS

| | | | | |
|---|---|---|---|---|
| 2002/0037186 | A1* | 3/2002 | Tanaka | 399/322 |
| 2007/0009275 | A1* | 1/2007 | Yokoyama | 399/69 |
| 2010/0303521 | A1* | 12/2010 | Ogawa et al. | 399/323 |
| 2011/0044735 | A1* | 2/2011 | Okuno et al. | 399/323 |

FOREIGN PATENT DOCUMENTS

| | | | |
|---|---|---|---|
| JP | 10074015 | A | 3/1998 |
| JP | 2000089603 | A | 3/2000 |
| JP | 2003-57892 | A | 2/2003 |
| JP | 2003323068 | A | 11/2003 |
| JP | 2005164895 | A | 6/2005 |
| JP | 2007071955 | A | 3/2007 |

OTHER PUBLICATIONS

Notification of Refusal for Japanese Patent Application No. 2011-103375; Date of Mailing: May 21, 2013 with English Translation.

* cited by examiner

*Primary Examiner* — Matthew G Marini
*Assistant Examiner* — Quang X Nguyen
(74) *Attorney, Agent, or Firm* — Cantor Colburn LLP

(57) ABSTRACT

A fixing device includes a fixing unit with a nip, two rollers, a guide member, a detection unit and an urging unit. The detection unit is disposed substantially parallel to the guide member opposite to the guide member across a recording medium conveyed between the nip and the two rollers. The detection unit detects jamming of the recording medium on the basis of a pressure greater than a predetermined value applied by the recording medium between the nip and the two rollers. The distance between the guide member and the detection unit is greater than the distance between the guide member and the recording medium passing between the nip and the two rollers while being urged by the urging unit.

10 Claims, 14 Drawing Sheets

FIG. 5

T

| | BASIS WEIGHT OF PAPER [g / m2] | | |
|---|---|---|---|
| | 80 OR SMALLER | GREATER THAN 80 SMALLER THAN250 | 250 OR GREATER |
| SUCTION FORCE OF SUCTION FAN | 60% | 80% | 100% |
| DISTANCE BETWEEN PAPER DETECTION PART AND GUIDE MEMBER | 4mm | 3mm | 4mm |

FIG.13

T2

| | BASIS WEIGHT OF PAPER [g / m2] | | |
|---|---|---|---|
| | 80 OR SMALLER | GREATER THAN 80 SMALLER THAN130 | 130 OR GREATER |
| SUCTION FORCE OF SUCTION FAN | 100% | 80% | 0% |
| URGING FORCE FROM SEPARATION NOZZLE | 100% | 80% | 0% |
| DISTANCE BETWEEN PAPER DETECTION PART AND GUIDE MEMBER | 4mm | 3mm | 4mm |

PRIOR ART

FIXING DEVICE AND IMAGE FORMING APPARATUS HAVING JAM DETECTION UNIT

BACKGROUND

1. Field of the Invention

The present invention relates to a fixing device and an image forming apparatus.

2. Description of Related Art

A typical image forming apparatus includes a fixing device that conveys a recording medium, such as paper, while fixing an image on the recording medium by pressure and heat applied to the recording medium.

In such an image forming apparatus, the recording medium conveyed by the fixing device may be jammed as foldings downstream in the conveying direction (for example, foldings S illustrated in FIG. 14). In such a case, the jammed recording medium may come into contact with rollers and belts in the fixing device and may damage the rollers and belts by applying pressure.

To detect such jamming, some image forming apparatuses include detection mechanisms disposed upstream and downstream of the fixing device in the conveying direction of the recording medium that detect the pass of the recording medium. In such an image forming apparatus, if a recording medium that has been detected to pass through the upstream area is not detected in the downstream area after a certain time, it is determined that the recording medium has been jammed in the downstream area, and operation is stopped.

However, with such a mechanism of detecting a jammed recording medium, the jammed recording medium can only be detected after a predetermined time. Thus, in some cases, the fixing device is damaged by the jammed recording medium before the operation of the image forming apparatus is stopped.

Nowadays, there is a need for image forming apparatuses capable of high-speed printing. An increase in printing speed requires an increase in the conveying speed of a recording medium conveyed by the fixing device. Thus, the rollers and belts of the fixing device are damaged by the foldings of a jammed recording medium in a shorter time once the recording medium is jammed. To prevent such damage of the fixing device, jamming of a recording medium must be detected at an earlier timing.

Accordingly, Japanese Unexamined Patent Application Publication No. 2003-57892 discloses an image forming apparatus including a lever that detects the pass of a recording medium by coming into contact with the recording medium in a conveying path downstream of a fixing device, and detecting jamming of a recording medium on the basis of the angle of the lever.

Unfortunately, the image forming apparatus disclosed in Japanese Unexamined Patent Application Publication No. 2003-57892 causes a decrease in image quality due to scratches formed by the lever coming into contact with the image surface of the recording medium that has been fixed by the fixing device, regardless of jamming.

If the lever is disposed away from the conveying path such that the lever and the recording medium come into contact with each other only if the recording medium is jammed, the jammed recording medium cannot be detected in the early stage because the jamming has proceed to form foldings large enough to push up the lever to an angle that allows the jamming to be detected.

If the lever is simply disposed away from the conveying path, the recording medium and the lever may come into contact because the path the recording medium is conveyed through fluctuates. In such a case, the image forming apparatus erroneously detects a jamming and stops operation. Hence, productivity of the image forming apparatus is reduced due to such erroneous detection.

SUMMARY

The present invention has been made in consideration of the above problems, and it is one of main objects to provide a fixing device and an image forming apparatus that quickly detect jamming of a recording medium conveyed at a high speed, maintains high image quality, and reduces erroneous detection of jamming of a recording medium.

In order to achieve at least one of the above-described objects, according to an aspect of the present invention, there is provided a fixing device including:

a fixing unit that has a nip conveying a recording medium while fixing an image to the recording medium by pressure and heat applied to the recording medium;

two rollers that are disposed downstream of the nip in a conveying direction of the recording medium and cooperating with each other to convey the recording medium discharged from the nip;

a guide member that is disposed between the nip and the two rollers, faces a first side of the recording medium, the first side having no recorded image, and guides the recording medium through a conveying path;

a detection unit that is disposed substantially parallel to the guide member opposite to the guide member across the recording medium conveyed between the nip and the two rollers, the detection unit detecting jamming of the recording medium on the basis of a pressure greater than a predetermined value applied by the recording medium between the nip and the two rollers; and an urging unit that urges the recording medium toward the guide member between the nip and the two rollers, wherein the distance between the nip and the two rollers is smaller than the length of the recording medium along the conveying direction, and the distance between the guide member and the detection unit is greater than the distance between the guide member and the recording medium passing between the nip and the two rollers while being urged by the urging unit.

Preferably, in the fixing device, the detection unit detects jamming of the recording medium at, at least, the midpoint between the downstream edge of the nip in the conveying direction and the position where the recording medium is nipped between the two rollers.

Preferably, in the fixing device, the detection unit detects jamming of the recording medium within a predetermined area downstream of the midpoint in the conveying direction.

Preferably, the fixing device further includes:

a position changing unit that changes the position of the detection unit with respect to the guide member;

a distance determining unit that determines the distance between the guide member and the detection unit based on the weight per unit area of the recording medium; and a position control unit that controls the operation of the position changing unit such that the distance between the guide member and the detection unit is set to the distance determined by the distance determining unit.

Preferably, the fixing device further includes:

an urging-force determining unit that determines the magnitude of an urging force applied by the urging unit based on the weight per unit area of the recording medium; and an urging control unit that controls the operation of the urging unit such that the magnitude of the urging force is set to the magnitude determined by the urging-force determining unit, wherein the distance determining unit determines the distance between the guide member and the detection unit based on the weight per unit area of the recording medium and the magnitude of the urging force to be applied by the urging unit determined by the urging-force determining unit.

Preferably, in the fixing device, the detection unit includes a pressure detecting unit that detects pressure applied by the recording medium.

Preferably, in the fixing device, the detection unit determines jamming of the recording medium when the detection unit continuously detects a pressure greater than a predetermined value applied by the recording medium for a predetermined time.

Preferably, in the fixing device, a plurality of the detection units is disposed along the width direction of the recording medium in a direction orthogonal with the conveying direction.

Preferably, in the fixing device, the urging unit includes an air-flow generating unit that generates an air flow urging the recording medium toward the guide member.

Preferably, in the fixing device, the nip is provided between paired second rollers, one of the second rollers disposed adjacent to the guide member forms a depression in the circumferential surface of the other second roller disposed adjacent to the detection unit, and the depression constitutes an urging unit.

BRIEF DESCRIPTION OF THE DRAWINGS

The present invention will become more fully understood from the detailed description given hereinbelow and the appended drawings, and thus are not intended to define the limits of the present invention, and wherein;

FIG. 5 illustrates an example data table correlating the basis weight of paper, the magnitude of the paper suction force of a suction fan, and the distance between a paper detection part and a guide member;

FIG. 13 illustrates an example data table correlating the basis weight of paper, the intensity of the paper suction force of a suction fan, the intensity of an urging force of a separation support nozzle, and the distance between a paper detection part and a guide member.

DETAILED DESCRIPTION OF PREFERRED EMBODIMENTS

An image forming apparatus 1 including a fixing device according to embodiments of the present invention will now be described in detail with reference to the accompanying drawings. The present invention should not be limited to the embodiments described below.

First Embodiment

Figure 1:
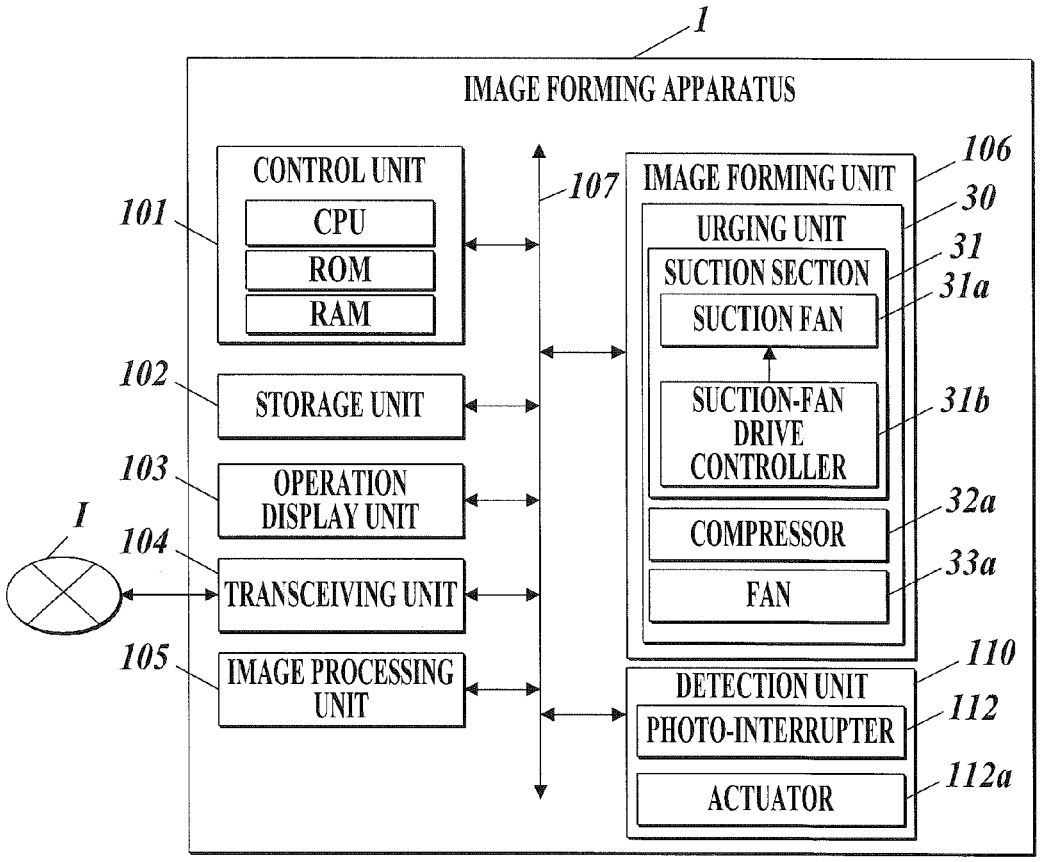
FIG. 1 is a schematic block diagram of an image forming apparatus according to a first embodiment of the present invention.

FIG. 1 is a block diagram schematically illustrating the configuration of an image forming apparatus 1 according to the first embodiment of the present invention.

As illustrated in FIG. 1, the image forming apparatus 1 includes, for example, a control unit 101, a storage unit 102, an operation display unit 103, a transceiving unit 104, an image processing unit 105, an image forming unit 106, and a detection unit 110. These units are connected to each other via a bus 107.

The control unit 101 includes a central processing unit (CPU), a read only memory (ROM), and a random access memory (RAM). The CPU of the control unit 101 reads out system programs and various processing programs stored in the ROM, loads these programs in the RAM, and comprehensively controls the operations of the units in the image forming apparatus 1 in accordance with the loaded programs.

The storage unit 102 includes, for example, a flash memory which holds various programs and data used by the units of the image forming apparatus 1.

The operation display unit 103 includes, for example, a display device (not shown), such as a liquid crystal display (LCD), which displays the operating conditions for various functions in response to display signals output from the control unit 101. The display screen of the LCD is covered with, for example, a pressure-sensitive (resistive) touch panel (not shown), which is composed of a grid of transparent electrodes. The touch panel detects the XY coordinates of a force point pressed with a finger or a stylus as a voltage value and outputs the detected position as an operating signal to the control unit 101. The operation display unit 103 includes various operating buttons (not shown), such as numeric buttons and a start button, and outputs operating signals to the control unit 101 in response to the operation of the buttons.

The transceiving unit 104 includes, for example, a communication circuit (not shown), and controls information communication between the image forming apparatus 1 and external devices via a communication network I conforming to a predetermined communication standard for, for example, a wire local area network (LAN) or a wireless LAN.

Specifically, the transceiving unit 104 receives printing jobs from external devices via the communication network I.

The communication network I is constructed of, for example, dedicated lines and/or existing general public lines and may be any type of network, such as a LAN or a wide area network (WAN). The communication network I includes, for example, various communication networks, such as a telephone network, an integrated services digital network (ISDN), dedicated lines, a mobile communication network, a satellite communication network, and a CATV network, and an Internet service provider that connects these communication networks.

The transceiving unit 104 may connect external devices and the image forming apparatus 1 via a predetermined interface (for example, a universal serial bus (USB)).

The image processing unit 105 performs image processing, such as predetermined color conversion (for example, YMCK data generation), the y correction of the YMCK data, and halftone processing, on image data (for example, image data contained in a printing job received from the transceiving unit 104) and outputs the processed image data (print data) to the image forming unit 106.

The image forming unit 106 forms an image on a recording medium (for example, paper P) corresponding to the print data output from the image processing unit 105.

The image forming unit 106 according to the first embodiment includes four electrostatic drums that transfer four colors, i.e., yellow (Y), magenta (M), cyan (C), and black (K) (tandem printing), for example.

Figure 2:
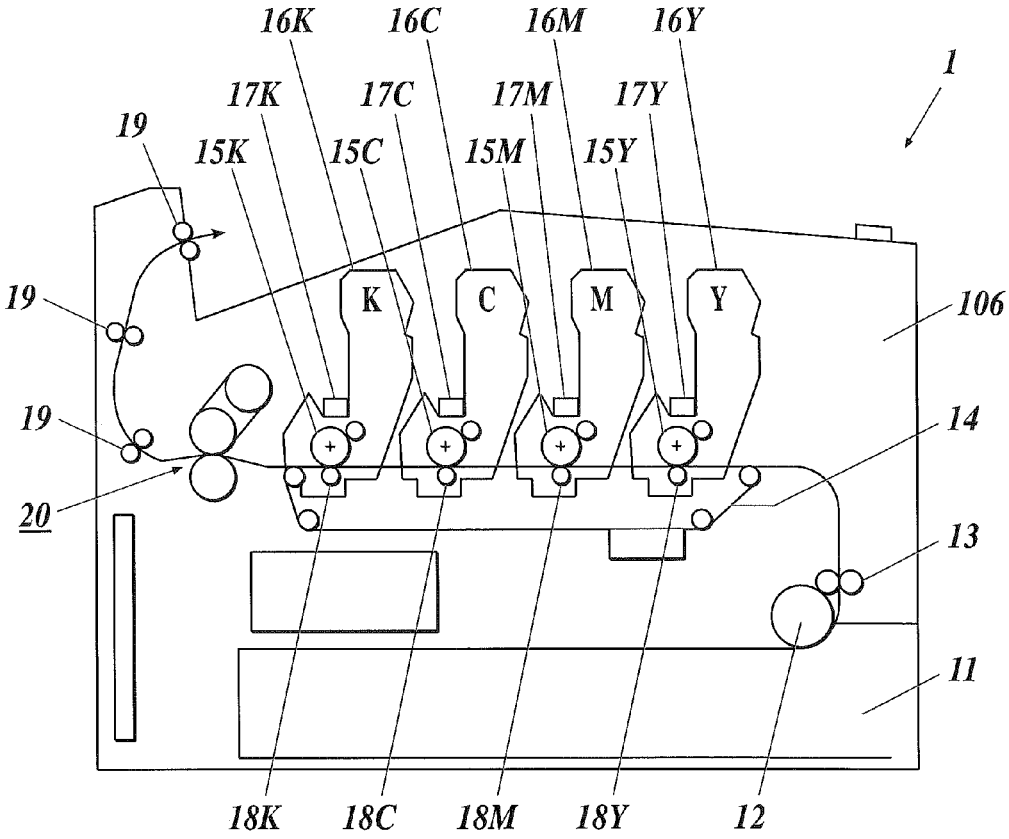
FIG. 2 illustrates essential components of an image forming unit.

FIG. 2 illustrates the main configuration of the image forming unit 106.

As illustrated in FIG. 2, the image forming unit 106 includes a cassette 11, a paper feeding roller 12, conveying rollers 13, a conveying belt 14, electrostatic drums 15Y, 15M, 15C, and 15K, printing units 16Y, 16M, 16C, and 16K, laser units 17Y, 17M, 17C, and 17K, transfer rollers 18Y, 18M, 18C, and 18K, a fixing unit 20, and output rollers 19.

The cassette 11 holds the paper P.

The paper feeding roller 12 draws out a single sheet of paper P from the paper stack disposed inside the cassette 11.

The conveying rollers 13 convey the paper P drawn out by the paper feeding roller 12 to the conveying belt 14.

The conveying belt 14 cooperates with the electrostatic drums 15Y, 15M, 15C, and 15K to transfer toner images to the paper P.

The transfer of a yellow (Y) toner image from the electrostatic drum 15Y will be described below as an example of toner image transfer.

The electrostatic drum 15Y is a cylindrical member rotationally driven by a driving unit (not shown). The circumferential surface of the cylinder is electrically charged by a charging unit (not shown). The laser unit 17Y forms an electrostatic latent image on the circumferential surface of the electrostatic drum 15Y. Specifically, the laser unit 17Y irradiates the circumferential surface of the charged electrostatic drum 15Y with a laser beam corresponding to the yellow image to be formed on the paper P on the basis of print data.

The printing unit 16Y forms a yellow (Y) toner image on the circumferential surface of the electrostatic drum 15Y.

Specifically, the printing unit 16Y includes a toner cartridge and a development section. The toner cartridge holds yellow (Y) toner and supplies the toner to the development section. The development section applies the toner from the toner cartridge to the latent image formed on the circumferential surface of the electrostatic drum 15Y for development of the latent image. Through development, a yellow (Y) toner image is formed on the circumferential surface of the electrostatic drum 15Y.

The transfer roller 18Y transfers the yellow (Y) toner image formed on the circumferential surface of the electrostatic drum 15Y to the paper P.

The transfer rollers 18Y is disposed opposite to the electrostatic drum 15Y across the conveying belt 14. The transfer rollers 18Y charges the paper P with a charge opposite to that of the toner image (opposite charging) at a moment the paper P is nipped between the conveying belt 14 and the electrostatic drum 15Y. Through opposite charging, the yellow (Y) toner image formed on the circumferential surface of the electrostatic drum 15Y is transferred on the paper P (secondary transfer).

Through a process similar to the process of transferring the yellow (Y) toner image from the electrostatic drum 15Y, a magenta (M) toner image is transferred from the electrostatic drum 15M, a cyan (C) toner image is transferred from the electrostatic drum 15C, and a black (K) toner image is transferred from the electrostatic drum 15K.

The conveying belt 14 conveys the paper P on which the four toner images have been transferred to the fixing unit 20.

The fixing unit 20 fixes the toner images transferred on the paper P. Details of the fixing unit 20 will be described below.

The output rollers 19 convey the paper P on which the toner images have been fixed by the fixing unit 20 and output the paper P to an output tray.

Figure 3:
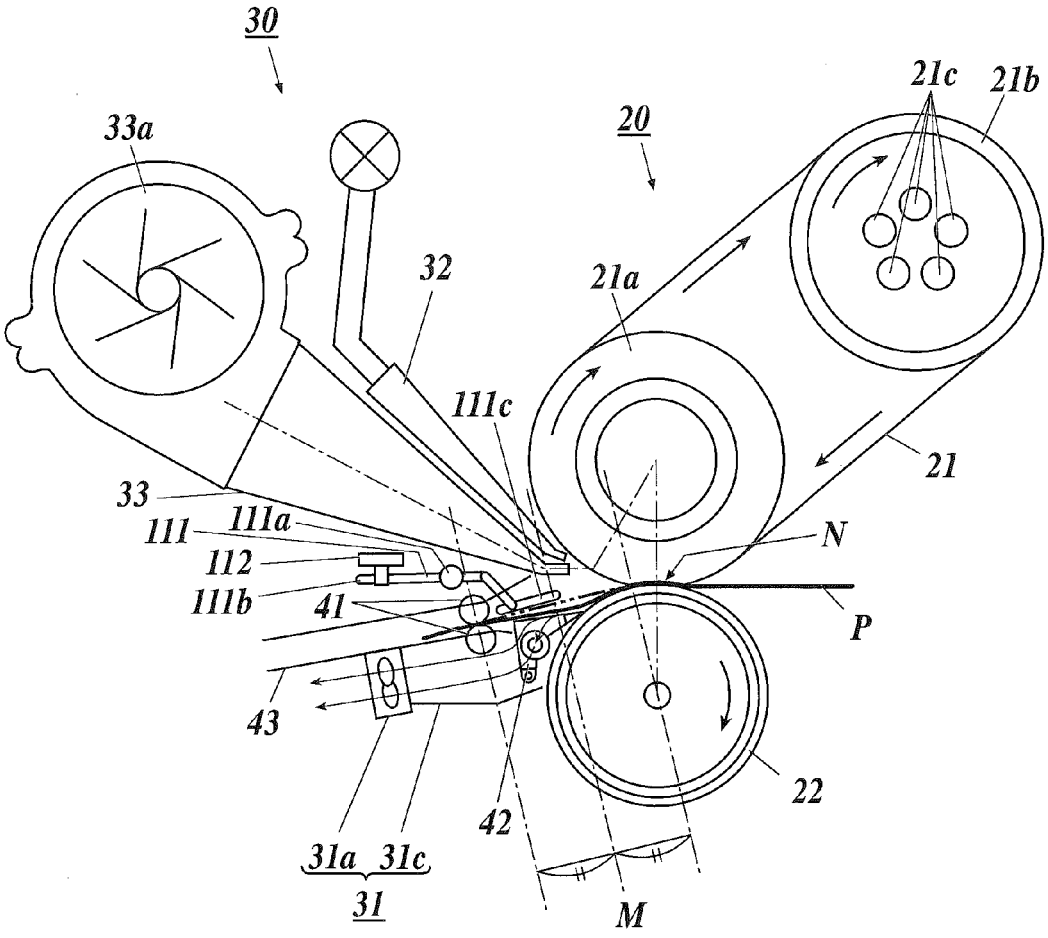
FIG. 3 illustrates an example configuration of a fixing unit, an urging unit, and a detection unit of a fixing device.

FIG. 3 illustrates an exemplary configuration of the fixing unit 20, an urging unit 30, and the detection unit 110 in the fixing device according to the first embodiment.

The fixing unit 20 includes a fixing belt 21 and a pressurizing roller 22.

The fixing belt 21 and the pressurizing roller 22 cooperate with each other and define an urging part (nip N) between the outer surface of the fixing belt 21 and the circumferential surface of the pressurizing roller 22. The pressurizing roller 22 driven by a driving unit (not shown) and the fixing belt 21 rotating in contact with the pressurizing roller 22 convey the paper P through the nip N, while pressure and heat are applied to the paper P to fix the toner images on the paper P. The fixing belt 21 and the pressurizing roller 22 convey the paper P through the nip N in a predetermined direction while the paper P is being subjected to the fixing process.

The fixing belt 21 is a single continuous belt surrounding a plurality of rollers (for example, rollers 21*a* and 21*b* in FIG. 3).

The rollers 21*a* and 21*b* are disposed on the inner side of the fixing belt 21. The rollers 21*a* and 21*b* are positioned such that the circumferential surfaces come into contact with the inner side of the fixing belt 21 and cooperate with each other to apply tension to the fixing belt 21.

The pressurizing roller 22 is disposed opposite to one of the rollers applying tension to the fixing belt 21 (for example, the roller 21*a* in FIG. 3) across the fixing belt 21. The pressurizing roller 22 cooperates with the roller 21*a* to nip the fixing belt 21 such that an urging part (nip N) is formed between the outer surface of the fixing belt 21 and the circumferential surface of the pressurizing roller 22.

The roller 21*a* and the pressurizing roller 22 are both rotationally driven by a driving unit (not shown). The rotating roller 21*a* drives the fixing belt 21. The pressurizing roller 22 is rotationally driven in a direction opposite to the rotating direction of the roller 21*a*. The driven fixing belt 21 and pressurizing roller 22 cooperate with each other to interleave the paper P at the nip N and convey the paper P while applying pressure to the paper P. The roller 21*a* is driven with a one-way clutch at a peripheral speed smaller than the peripheral speed of the pressurizing roller 22. When the fixing belt 21 and the pressurizing roller 22 are in pressure contact with each other, the pressurizing roller 22 controls the speed of the roller 21*a*.

At least one of the rollers (for example, the roller 21*b* in FIG. 3) is heated by a heating unit (for example, a heating unit 21*c* disposed inside the roller 21*b*, as illustrated in FIG. 3). The roller 21*b* heated by the heating unit 21*c* transfers the heat to the fixing belt 21. The fixing belt 21 is heated by the heat from the roller 21*b*. The heated fixing belt 21 heats the paper P at the nip N.

The fixing belt 21 and the pressurizing roller 22 fix the toner images on the paper P at the nip N, convey the paper P after fixing downstream of the conveying direction.

Hereinafter, the terms "upstream" and "downstream" are used in respect to the conveyed direction of the paper P.

The fixing unit 20 according to this embodiment conveys (discharges) the paper P downstream at a predetermined speed (for example, 500 mm/s).

The discharged paper P is nipped between the discharge rollers 41,41 and is conveyed further downstream. The discharge rollers 41,41 are disposed downstream of the nip N and cooperate with each other to convey the recording medium (paper P) that has been discharged from the nip N.

The distance between the nip N and two rollers (for example, the discharge rollers 41,41) is smaller than the length of the recording medium (paper P) in the conveyed direction. Specifically, the distance between the nip N and the discharge rollers 41,41 is set to a predetermined length (for example, 100 mm) that is smaller than the length of a usable recording medium (paper P) that has the smallest length in the conveyed direction, in the image forming apparatus 1. In this way, the paper P is conveyed while it is nipped in the nip N and/or between the discharge rollers 41,41.

A guide member 42 is disposed between the nip N and the discharge rollers 41,41.

The guide member 42 is disposed between the nip N and two rollers (for example, the discharge rollers 41,41), faces a first side on which an image is not formed of a recording medium (paper P), and guides the recording medium (paper P) through a conveying path.

Specifically, in this embodiment, a second side of the paper P on which an image is formed faces the fixing belt 21, which is disposed above the pressurizing roller 22, when the paper P is nipped in the nip N that is formed between the vertically stacked fixing belt 21 and pressurizing roller 22. The guide member 42 is disposed below the conveying path of the paper P between the nip N and the discharge rollers 41,41.

The guide member 42 according to this embodiment also functions as a separator that separates the paper P from the pressurizing roller 22 if the paper P is attached to the pressurizing roller 22 after being conveyed through (discharged from) the nip N. Specifically, the separator of the guide member 42 extends along the entire length of the nip N in the axial direction of the pressurizing roller 22 and the upper surface of the separator guides the paper P through the conveying path.

In this embodiment, the guide member 42 guides a recording medium (paper P) through the conveying path and also functions as a separator. Such a configuration is for exemplification purposes and does not limit the scope of the invention. For example, the guide member may face the first side on which an image is not formed on a recording medium (paper P) between the nip N and the two rollers (for example, the discharge rollers 41,41) and guide the recording medium through a conveying path, without functioning as a separator.

The urging unit 30 is disposed between the nip N and two rollers (for example, the discharge rollers 41,41) and urges the recording medium against the guide member 42.

The urging unit 30 includes a suction section 31 and separation support nozzles 32 and 33.

The suction section 31 urges the paper P by pulling the paper P toward the guide member 42, which is disposed on the conveying path of the paper P being conveyed through (discharged from) the nip N.

The suction section 31 includes, for example, a suction fan 31*a* and a suction-fan drive controller 31*b* (see FIG. 1). The suction fan 31*a* sends air from the upstream side to the downstream side of the conveyed direction of the paper P. The guide member 42 has a hole that allows an air flow generated by the suction fan 31*a* to pass through the guide member 42 from top to bottom, i.e., from the conveying path of the paper P, which passes above the guide member 42, to an area below the guide member 42. The air sent from the suction fan 31*a* generates an air flow from an area above the guide member 42 to the suction fan 31*a* through an area below the guide member 42. That is, the suction fan 31*a* generates an air flow in a direction that causes the paper P that has been conveyed through (discharged from) the nip N to be urged toward and contact the guide member 42.

The suction-fan drive controller 31*b* performs various types of processes associated with the operation of the suction fan 31*a*, such as turning on/off the suction fan 31*a* and controlling the operation of the suction fan 31*a* in accordance with the static pressure in the suction fan 31*a* instructed by the control unit 101.

The suction fan 31*a* of the image forming apparatus 1 in accordance with this embodiment is provided with, for example, six fan motors having a maximum static pressure of 210 Pa and aligned in the axial direction of the pressurizing roller 22. The image forming apparatus 1 also includes a duct 31*c* that guides air through a path from the suction fan 31*a* to the guide member 42. This is, however, merely an exemplary configuration and does not limit the scope of the invention.

The separation support nozzles 32 and 33 generate an air flow that promotes the separation of the paper P that has been discharged from the nip N of the fixing unit 20 from the fixing belt 21.

Specifically, the separation support nozzles 32 and 33 are disposed downstream of the nip N in the conveying direction of the paper and inject air between the fixing belt 21 and the paper P that has been conveyed through (discharged from) the nip N and has become attached to the fixing belt 21. The paper P receives air injection from the separation support nozzles 32 and 33 and is urged downward on the fixing belt 21, i.e., toward the guide member 42.

In this embodiment, the separation support nozzle 32 ejects compressed air supplied from a compressor 32*a*, and the separation support nozzle 33 ejects air from an air flow generated by the operation of a fan 33*a*. This is, however, merely an exemplary configuration and does not limit the scope of the invention.

Among two rollers that hold a recording medium (paper P) in the nip N (for example, the roller 21*a* and the pressurizing roller 22), one of the rollers (the pressurizing roller 22), which is disposed closer to the guide member 42, forms a depression in the circumferential surface of the other roller (roller 21*a*), which is disposed closer to a lever 111 of the detection unit 110.

Specifically, the circumferences of the roller 21*a* and 21*b* and the pressurizing roller 22 of the fixing unit 20 are covered with resin, such as silicone rubber. As illustrated in FIG. 3, the thickness of the circumferential resin of the roller 21*a* (for example, 20 mm) is greater than the thickness of the circumferential resin of the pressurizing roller 22 (for example, 1 mm) such that the resin is compressed under pressure. In this way, a concave depression having a predetermined depth (for example, 3 mm) is formed in the circumferential surface of the roller 21*a* due to the pressure applied upward by the pressurizing roller 22 (for example, a load of 2000 N). The fixing belt 21 follows the depression in the roller 21*a* and passes through an upward convex path at the nip N.

The depression in the roller 21*a* causes the nip N to protrude toward the lever 111 of the detection unit 110 when viewed from the guide member 42. The nip N forms an arc along the conveying direction that curves toward the guide member 42 from the midpoint to the downstream end of the nip N. The paper P follows the shape of the nip N and is discharged from the downstream end of the nip N. As a result, the paper P is urged toward the guide member 42.

That is, the fixing unit 20 includes two second rollers (for example, the pressurizing roller 22 and the roller 21*a*) that form the nip N. One of the second rollers (pressurizing roller), which is disposed closer to the guide member 42, forms a depression in the circumferential surface of the other second roller (roller 21*a*), which is disposed closer to the detection unit (for example, a paper detection part 111*c* of the lever 111). This depression functions as an urging unit.

The detection unit 110 is disposed opposite to the guide member 42 across a recording medium (paper P) that is conveyed between the nip N and two rollers (for example, the discharge rollers 41,41). The detection unit 110 detects jamming of a recording medium between the nip N and the two rollers if the pressure applied by the jammed recording medium is greater than a predetermined value.

Specifically, the detection unit 110 includes the lever 111 and a photo-interrupter 112.

The lever 111 moves in response to the pressure applied by the jammed recording medium between the nip N and the discharge rollers 41,41. The lever 111 is supported by a pivot axis 111*a* positioned downstream of the nip N in such a manner that the lever 111 pivots. A first end 111*b* of the lever 111 is positioned downstream of the pivot axis 111*a*, and a paper detection part 111*c* on a second end is positioned upstream.

The paper detection part 111*c* is disposed substantially parallel with the upper surface of the guide member 42.

The paper detection part 111*c* is positioned such that the distance between the guide member 42 and the paper detection part 111*c* is greater than the distance between the guide member 42 and the conveying path of a recording medium (paper P) that is urged by the urging unit 30 and passes between the nip N and two rollers (for example, the discharge rollers 41,41). That is, the paper detection part 111*c* is positioned such that it does not come into contact with the paper P that passes between the nip N and the discharge rollers 41,41 without jamming.

Figure 4:
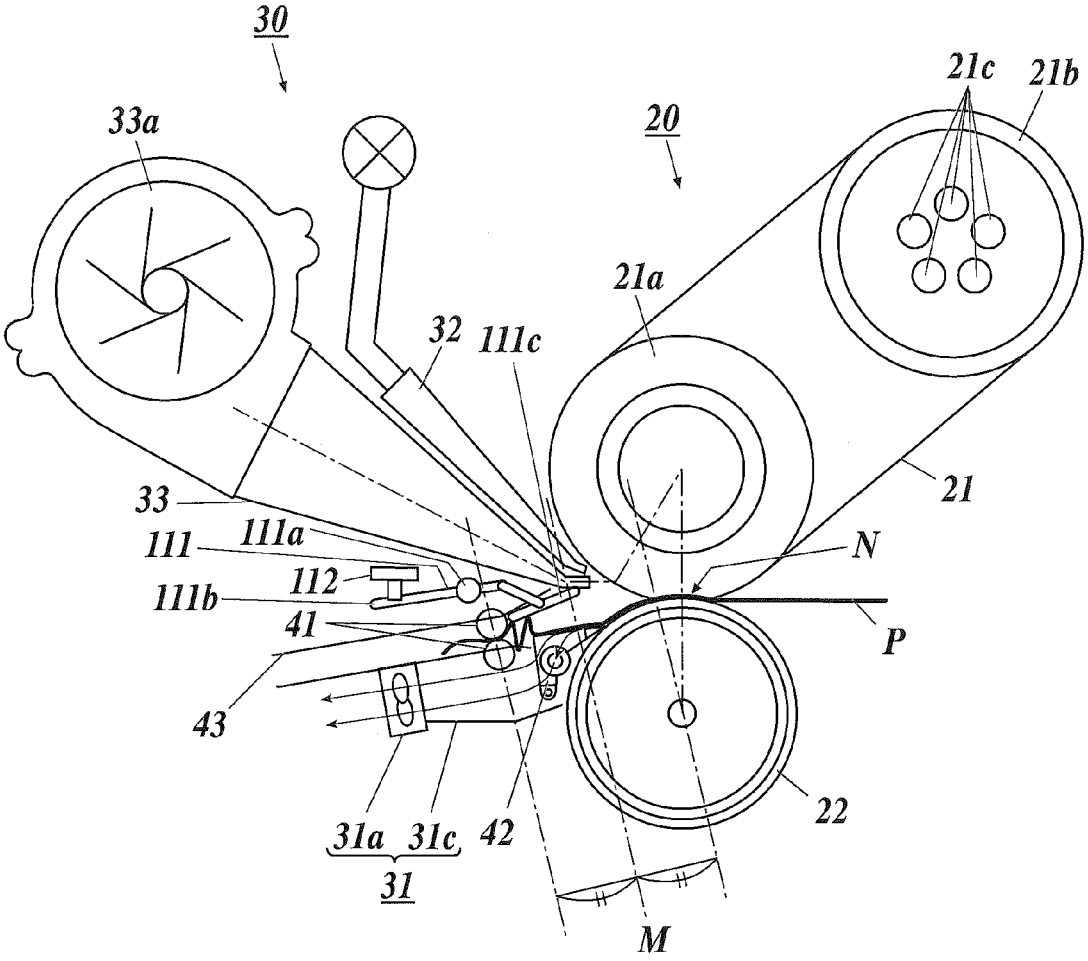
FIG. 4 illustrates jamming of paper between a nip and discharge rollers in the configuration including the fixing unit, the urging unit, and the detection unit illustrated in FIG. 3.
Figure 6:
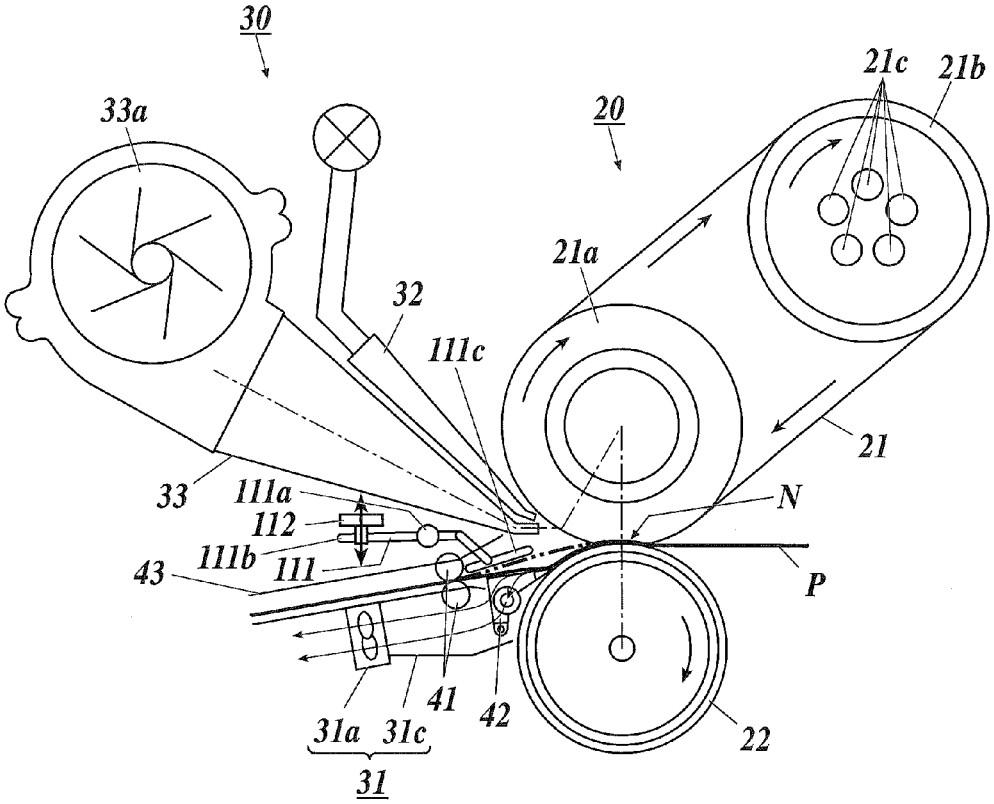
FIG. 6 illustrates the distance between the paper detection part and the guide member for a basis weight of paper of greater than 80 g/m$^2$ and smaller than 250 g/m$^2$.

As illustrated in FIG. 4, when the paper P is jammed between the nip N and the discharge rollers 41,41, the paper detection part 111*c* receives upward pressure from the jammed paper P and moves upward. While the paper detection part 111*c* moves upward, the first end 111*b* of the lever 111 moves downward. This operation switches the blocking of light of the photo-interrupter 112.

The photo-interrupter 112 includes a light-emitting part and a light-receiving part, which are disposed opposite to each other with respect to the first end 111*b* of the lever 111. The light-emitting part includes a light-emitting element, which emits light to the light-receiving part. The light-receiving part includes a light-receiving element, which detects the light from the light-emitting part.

When the paper P is not positioned between the nip N and the discharge rollers 41,41 and when the paper P passes between the nip N and the discharge rollers 41,41 without jamming, the first end 111*b* of the lever 111 is positioned between the light-emitting part and the light-receiving part of the photo-interrupter 112 such that the light path is blocked between the light-emitting part and the light-receiving part. When the paper detection part 111*c* moves upward due to jamming of the paper P, the first end 111*b* of the lever 111 moves downward to open the light path between the light-emitting part and the light-receiving part such that light emitted from the light-emitting part reaches the light-receiving part in the photo-interrupter 112.

Specifically, the photo-interrupter 112 according to this embodiment is an inverted U-shaped member composed of the light-emitting part and the light-receiving part, which constitute two substantially parallel sides, and an orthogonal intermediate side connecting the two parallel sides. The first end 111*b* of the lever 111 is capable of moving vertically between the light-emitting part and the light-receiving part of the photo-interrupter 112 which corresponds to the two substantially parallel sides of the inverted U-shape.

The lever 111 is urged by an urging member, such as a spring (not shown), disposed at a predetermined position such that the first end 111*b* moves upward and the paper detection part 111*c* moves downward upon application of a predetermined force. In this way, the first end 111*b* of the lever 111 is in contact with the intermediate side of the photo-interrupter 112 when the paper P is not positioned between the nip N and the discharge rollers 41,41 or when the paper P passes between the nip N and the discharge rollers 41,41 without jamming. In other words, when the paper P is not jammed, the first end 111*b* of the lever 111 is engaged with the photo-interrupter 112, maintaining a constant angle between the first end 111*b* and the paper detection part 111*c*, where the pivot axis 111*a* is the origin. The first end 111*b* of the lever 111 is positioned inside the U-shaped photo-interrupter 112, blocking the light path between the light-emitting part and the light-receiving part.

If the paper P is jammed, the paper detection part 111*c* moves upward, causing the first end 111*b* of the lever 111 to move downward. As a result, the first end 111*b* is disengaged from the photo-interrupter 112 to open the light path between the light-emitting part and the light-receiving part.

Upon detection of the light from the light-emitting part by the light-receiving part, the photo-interrupter 112 outputs a predetermined signal (hereinafter referred to as "detection signal").

The control unit 101 detects the jamming of the paper P on the basis of a detection signal output from the photo-interrupter 112.

Specifically, the control unit 101 determines that the paper P is not jammed when a detection signal is not output from the photo-interrupter 112.

In contrast, the control unit 101 determines that the paper P is jammed when a detection signal is output from the photo-interrupter 112. Upon determination of the jamming of the paper P, the control unit 101 stops the operation of the relevant units including the fixing unit 20 of the image forming unit 106 and stops the transfer of the paper P. In this way, the control unit 101 prevents the jamming of the paper P from worsening (for example, an increase in the folded area of the paper P due to jamming).

The urging force applied to the lever 111 by the urging member, such as a spring, is set to a level that does not interfere with the upward movement of the paper detection part 111*c* due to pressure applied by the jammed paper P.

That is, a detection unit (for example, the lever 111 and the photo-interrupter 112) detects the jamming of a recording medium (paper P) on the basis of the application of pressure greater than a predetermined value (for example, pressure that causes the paper detection part 111*c* to move upward against the urging force applied to the lever 111 by the urging member, such as a spring).

If the jamming of the paper P is unconditionally detected on the basis of an output detection signal, jamming may be erroneously detected when paper P that is not jammed (hereinafter referred to as "unjammed paper") comes into contact with and pushes upward the paper detection part 111*c* for some reason. Unjammed paper P may come into contact with the paper detection part 111*c*, for example, when the paper P is conveyed while the downstream edge of the paper P is separated from the guide member 42.

Thus, in this embodiment, the control unit 101 detects the jamming of a recording medium when the recording medium (paper P) applies a pressure greater than a predetermined value to the paper detection part 111*c* continuously for a predetermined time (for example, 100 ms).

The predetermined time is set in consideration of, for example, the urging force applied to the lever 111 by the urging member, such as a spring, the inertial force applied to the lever 111, the positional relationship between the photo-interrupter 112 and the lever 111, and the force applied to the lever 111, which is calculated based on the conveying speed of the paper P when the paper P collides with the paper detection part 111*c*.

The photo-interrupter 112 according to this embodiment moves vertically in response to the operation of an actuator 112*a*. The actuator 112*a* holds the position of the photo-interrupter 112 after moving it vertically.

In response to the vertical movement of the photo-interrupter 112, the first end 111*b* of the lever 111, which is engaged with the photo-interrupter 112, moves vertically. At the same time, the paper detection part 111*c* also moves vertically to a direction opposite to the vertical movement of the first end 111*b* of the lever 111. The vertical movement of the paper detection part 111*c* changes the distance between the paper detection part 111*c* and the guide member 42.

That is, the actuator 112*a* changes the position of the detection unit (for example, the paper detection part 111*c* of the lever 111) relative to the guide member 42.

The control unit 101 controls the operation of the actuator 112*a* to change the distance between the paper detection part 111*c* and the guide member 42 by controlling the vertical position of the photo-interrupter 112.

For example, the control unit 101 determines the magnitude of the urging force applied by the urging unit (for example, the suction fan 31*a* of the urging unit 30) on the basis of the weight per unit area (basis weight) of a recording medium (paper P). The control unit 101 controls the operation of the urging unit (for example, the suction fan 31*a* of the urging unit 30) such that the urging unit applies an urging force of the determined magnitude.

The control unit 101 determines the distance between the detection unit (for example, the paper detection part 111*c* of the lever 111) and the guide member 42 on the basis of the weight per unit area (basis weight) of the recording medium (paper P) and the determined urging force to be applied by the urging unit (for example, the suction fan 31*a* of the urging unit 30). The control unit 101 controls the operation of a position changing unit (for example, the actuator 112*a*) such that the distance between the detection unit (for example, the paper detection part 111*c* of the lever 111) and the guide member 42 is set to the determined distance.

Specifically, the storage unit 102 stores a data table T, such as that illustrated in FIG. 5, correlating the basis weight of paper, the magnitude of the suction force applied to the paper P by the suction fan 31*a* of the urging unit 30, and the distance between the paper detection part 111*c* and the guide member 42. The ROM of the control unit 101 or the storage unit 102 holds data (not shown) correlating the paper type with the basis weight of paper. The control unit 101 stores, in the storage unit 102, information on the type of the paper used in image formation selected by the user through the operation display unit 103 or other interfaces.

Upon reception of a start instruction for image formation from the user, the control unit 101 identifies the type of the paper P to be used in image formation and determines the basis weight of the paper P on the basis of the paper type. The control unit 101 reads out the data table T from the storage unit 102 and determines the distance between the paper detection part 111*c* and the guide member 42 and the suction force of the suction fan 31*a* corresponding to the basis weight of the paper. Then, the control unit 101 controls the operation of the actuator 112*a* such that the distance between the paper detection part 111*c* and the guide member 42 is set to a predetermined value. The control unit 101 controls the operation of the suction-fan drive controller 31*b* such that the suction force of the suction fan 31*a* is set to the determined value.

An exemplary correspondence relationship among the basis weight of the paper, the distance between the paper detection part 111*c* and the guide member 42, and the form of the jammed paper P is described with reference to FIGS. 3 to 10.

For example, paper that has a basis weight of 80 g/m$^2$ or smaller is thinner and lighter than paper that has a basis weight greater than 80 g/m$^2$. Thus, the paper P is more susceptible to the influence of the urging force toward the guide member 42 by the air from the suction fan 31*a*. If the paper P is excessively urged toward the guide member 42, the paper P may be damaged as a result of strong rubbing by the guide member 42. Hence, the data table T contains data on a setting for paper having a basis weight of 80 g/m$^2$ or smaller in which the suction force of the suction fan 31*a* is reduced (for example, 60%) compared to that for paper having a basis weight greater than 80 g/m$^2$. The control unit 101 outputs an instruction corresponding to this setting to the suction-fan drive controller 31*b* and controls the static pressure of the suction fan 31*a*.

When the basis weight of the paper is 80 g/m$^2$ or smaller, the force urging the paper P toward the guide member 42 is relatively reduced because the suction force of the suction fan 31*a* is set relatively small. Thus, in some cases, the paper P conveyed through (discharged from) the nip N does not come into close contact with the guide member 42 and is conveyed to the discharge rollers 41,41 while slightly floating above the guide member 42. In such a case, if the distance between the paper detection part 111*c* and the guide member 42 is too small, the downstream edge of the paper P and the paper detection part 111*c* may collide and/or rub against each other. Hence, the data table T contains data on a setting for paper having a basis weight of 80 g/m$^2$ or smaller in which the distance between the paper detection part 111*c* and the guide member 42 is set based on the suction force of the suction fan 31*a* and in consideration of the fluctuation in the path through which the paper P is conveyed, such that the normally conveyed paper P and the paper detection part 111*c* do not come into contact (for example, 4 mm). The control unit 101 controls the operation of the actuator 112*a* in accordance with this setting and controls the distance between the paper detection part 111*c* and the guide member 42 (see FIG. 3).

The thickness of the paper P having a basis weight of 80 g/m$^2$ or smaller is smaller than the thickness of paper having a basis weight greater than 80 g/m$^2$, and the stiffness of the paper P is relatively small. Thus, the paper P jammed in the conveying path between the nip N and two rollers (for example, the discharge rollers 41,41) is pushed forward in the area in front of the discharge rollers 41,41 and is fan-folded in the conveying path between nip N and the discharge rollers 41,41.

As illustrated in FIG. 4, the paper detection part 111*c* is positioned so as to detect the pressure from a recording medium (paper P) within a predetermined area downstream of the midpoint between the downstream edge of the nip N and the position where the recording medium is nipped between the two rollers (for example, the area between the discharge rollers 41,41 and the intersection of the paper detection part 111*c* and a middle line M indicating the midpoint between the downstream edge of the nip N and the position where the recording medium is nipped between the two rollers). Specifically, the paper detection part 111*c* includes, for example, a plate-like member that is disposed substantially parallel to the guide member 42 over the area between the intersection and the discharge rollers 41,41.

The paper detection part 111*c* is pushed upward near the discharge rollers 41,41 by the jammed folded paper P. As a result, the light emitted from the light-emitting part of the photo-interrupter 112 is no longer blocked by the first end 111*b* of the lever 111 and reaches the light-receiving part, allowing the photo-interrupter 112 to output a detection signal. Consequently, the control unit 101 detects the jamming of the paper P.

For example, paper that has a basis weight greater than 80 g/m$^2$ and smaller than 250 g/m$^2$ is thicker and heavier than paper that has a basis weight of 80 g/m$^2$ or smaller. Thus, the paper P receives a greater urging force toward the guide member 42 compared to that received by paper having a basis weight of 80 g/m$^2$ or smaller. In this way, the paper P can be conveyed through the conveying path while being in contact with the guide member 42 and is rarely damaged. Hence, the data table T contains data on a setting for paper having a basis weight greater than 80 g/m$^2$ and smaller than 250 g/m$^2$ in which the suction force of the suction fan 31*a* is greater (for example, 80%) than that of paper having a basis weight of 80 g/m$^2$ or smaller. The control unit 101 outputs an instruction corresponding to this setting to the suction-fan drive controller 31*b* and controls the static pressure of the suction fan 31*a*.

When the basis weight of the paper is greater than 80 g/m$^2$ and smaller than 250 g/m$^2$, the suction force of the suction fan 31*a* is set greater than that of paper having a basis weight of 80 g/m$^2$ and smaller. As a result, the paper P conveyed through (discharged from) the nip N passes through the conveying path while being in contact with the guide member 42. At this time, if the distance between the paper detection part 111*c* and the guide member 42 is undesirably large, the jamming of the paper P may not be detected because the jammed paper P does not come into contact with the paper detection part 111*c*. Hence, the data table T contains data on a setting for paper having a basis weight greater than 80 g/m$^2$ and smaller than 250 g/m$^2$ in which the distance between the paper detection part 111*c* and the guide member 42 is set based on the suction force of the suction fan 31*a* and in consideration of the paper P passing through the conveying path while being in contact with the guide member 42, such that the normally conveyed paper P and the paper detection part 111*c* do not come into contact (for example, 3 mm). The control unit 101 controls the operation of the actuator 112*a* in accordance with this setting and controls the distance between the paper detection part 111*c* and the guide member 42 (see FIG. 6).

Figure 7:
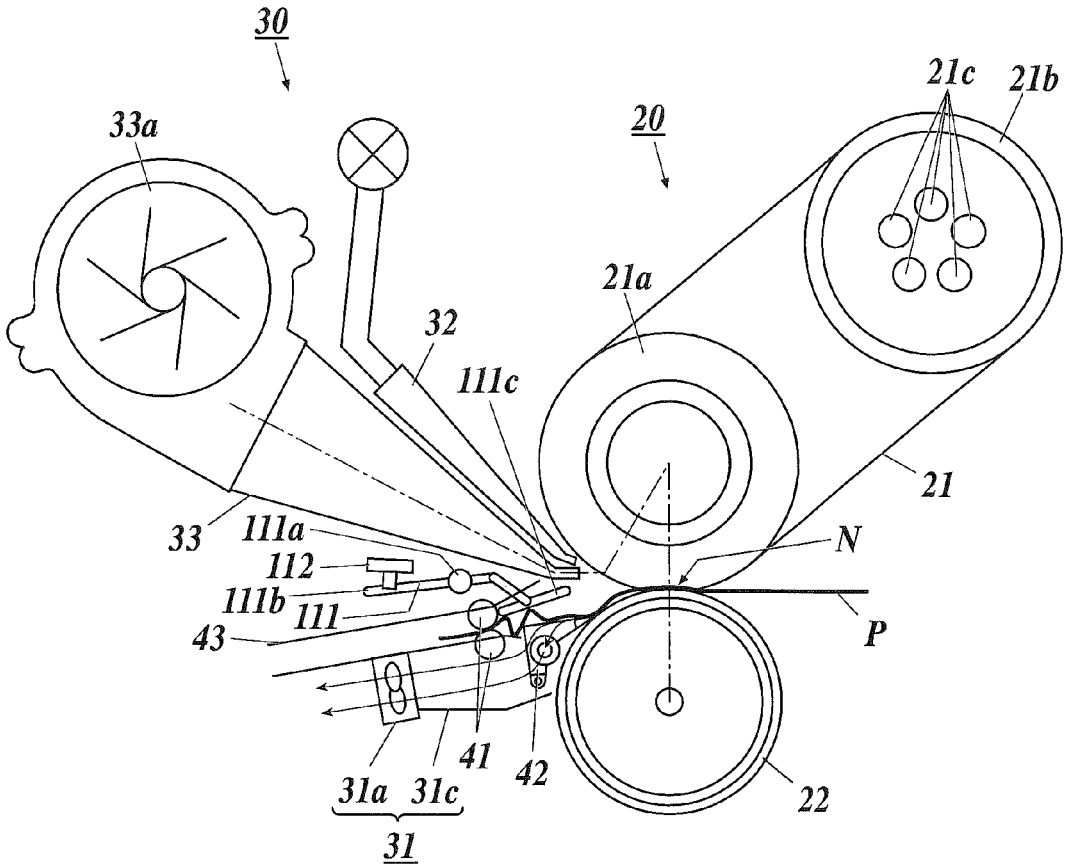
FIG. 7 illustrates jamming of paper having a basis weight of greater than 80 g/m$^2$ and smaller than 250 g/m$^2$.
Figure 8:
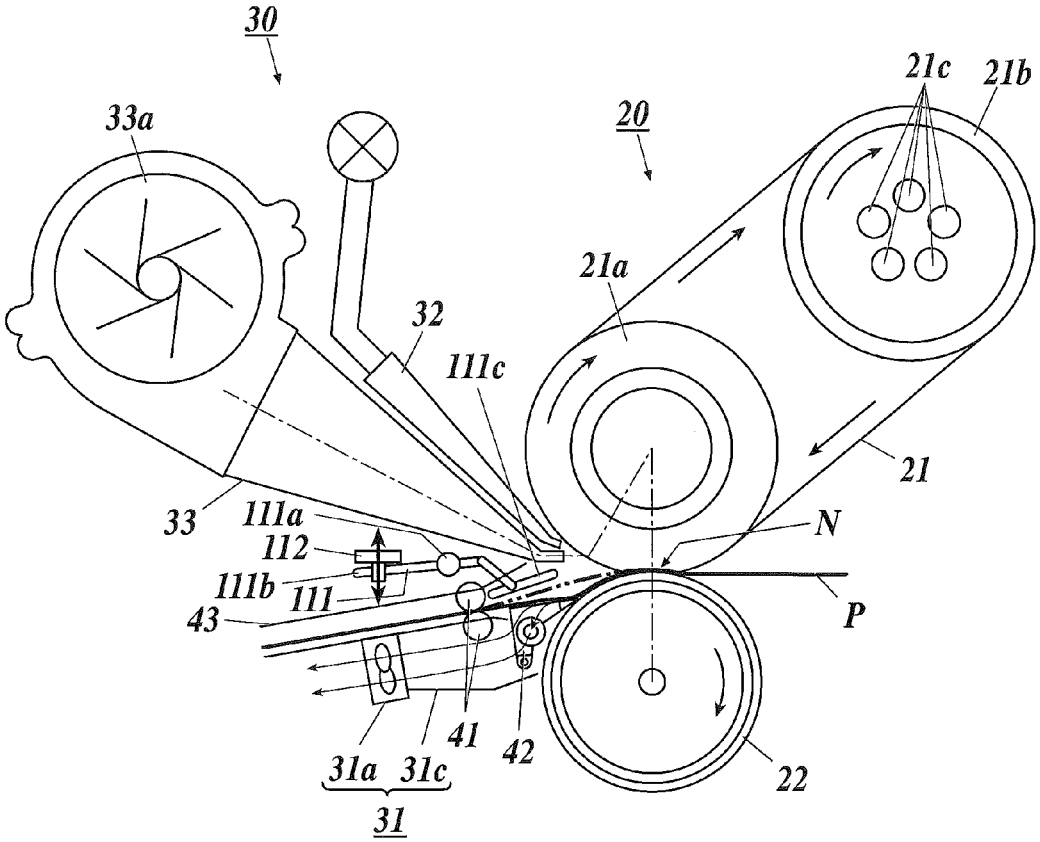
FIG. 8 illustrates the distance between the paper detection part and the guide member for a basis weight of paper of 250 g/m$^2$ or greater.

The thickness of the paper P having a basis weight greater than 80 g/m$^2$ and smaller than 250 g/m$^2$ is large compared to the thickness of paper having a basis weight of 80 g/m$^2$ or smaller, and the stiffness of the paper P is relatively large. Thus, the paper P jammed in the conveying path between the nip N and two rollers (for example, the discharge rollers 41,41) is pushed forward and fan-folded in the area in front of the discharge rollers 41,41 in the conveying path between the nip N and the discharge rollers 41,41. The foldings cover a larger area of the paper P due to relatively large stiffness of the paper P, causing the foldings to be formed further upstream compared to the foldings formed in paper having a basis weight of 80 g/m$^2$ or smaller. As illustrated in FIG. 7, the paper detection part 111*c* is pushed upward near the discharge rollers 41,41 by the foldings of the paper P formed further upstream compared to the foldings formed in paper having a basis weight of 80 g/m$^2$ or smaller. As a result, the light emitted from the light-emitting part of the photo-interrupter 112 is no longer blocked by the first end 111*b* of the lever 111 and reaches the light-receiving part, allowing the photo-interrupter 112 to output a detection signal. Consequently, the control unit 101 detects the jamming of the paper P.

For example, paper that has a basis weight of 250 g/m$^2$ or greater is thicker and heavier than paper that has a basis weight smaller than 250 g/m$^2$. Thus, the paper P is less susceptible to the influence of the urging force toward the guide member 42 by the air from the suction fan 31*a*. If the force urging the paper P toward the guide member 42 is small, the paper P cannot come into sufficient contact with the guide member 42 in some cases. Hence, the data table T contains data on a setting for paper having a basis weight of 250 g/m$^2$ or greater in which the suction force of the suction fan 31*a* is increased (for example, 100%) compared to that for paper having a basis weight smaller than 250 g/m$^2$. The control unit 101 outputs an instruction corresponding to this setting to the suction-fan drive controller 31*b* and controls the static pressure of the suction fan 31*a*.

If the basis weight of the paper is 250 g/m$^2$ or greater, the suction force of the suction fan 31*a* is set relatively large, but the paper P is less susceptible to the influence of the urging force toward the guide member 42 by the air from the suction fan 31*a*. Thus, in some cases, the paper P conveyed through (discharged from) the nip N does not come into tight contact with the guide member 42 and is conveyed to the discharge rollers 41,41 while slightly floating above the guide member 42. In such a case, if the distance between the paper detection part 111*c* and the guide member 42 is too small, the downstream edge of the paper P and the paper detection part 111*c* may collide and/or rub against each other. Hence, the data table T contains data on a setting for paper having a basis weight of 250 g/m$^2$ or greater in which the distance between the paper detection part 111*c* and the guide member 42 is set in consideration of the fluctuation in the path through which the paper P is conveyed, such that the normally conveyed paper P does not come into contact with the paper detection part 111*c* (for example, 4 mm). The control unit 101 controls the operation of the actuator 112*a* in accordance with this setting and controls the distance between the paper detection part 111*c* and the guide member 42 (see FIG. 8).

Figure 9:
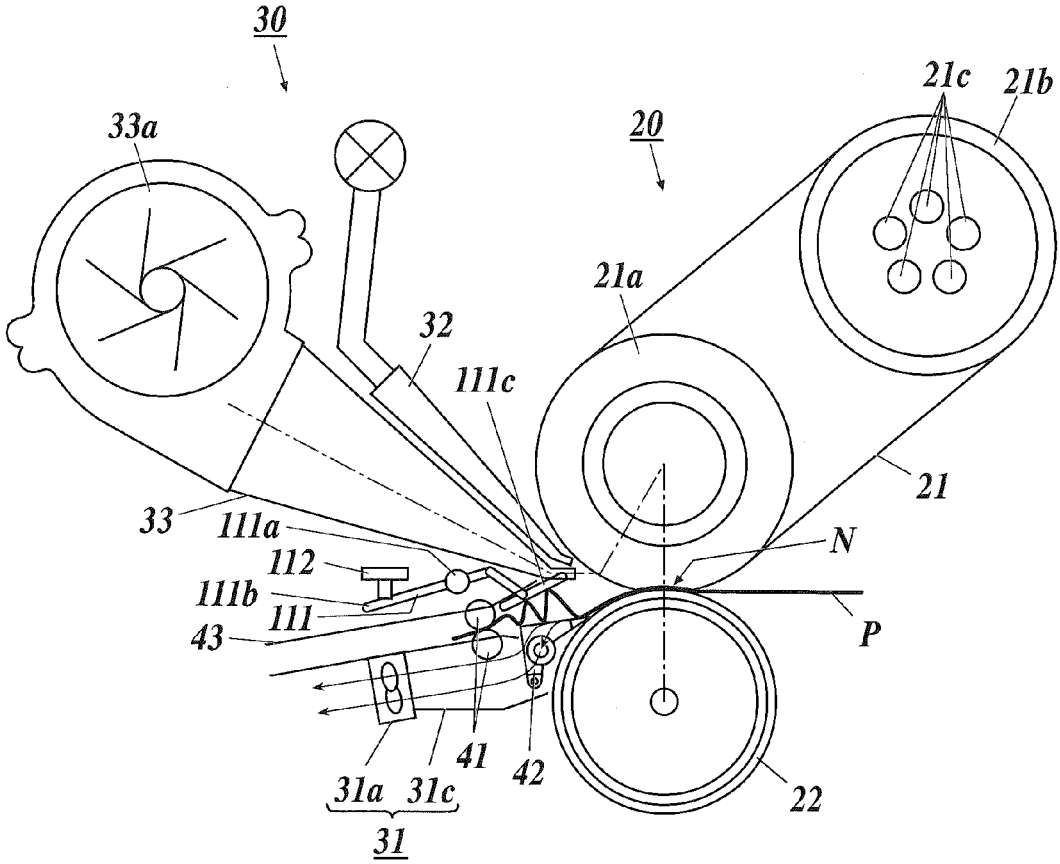
FIG. 9 illustrates jamming of paper having a basis weight of 250 g/m$^2$ or greater.

The thickness of the paper P having a basis weight of 250 g/m$^2$ or greater is large compared to the thickness of paper having a basis weight of 250 g/m$^2$ or smaller, and the stiffness of the paper P is relatively large. Thus, the paper P jammed in the conveying path between the nip N and two rollers (for example, the discharge rollers 41,41) is pushed forward from the nip N in the area in front of the discharge rollers 41,41 and is fan-folded in the conveying path between the nip N and the discharge rollers 41,41. The foldings cover a larger area of the paper P due to relatively large stiffness of the paper P, causing the foldings to be formed further upstream compared to the foldings formed in paper having a basis weight smaller than 250 g/m$^2$. For example, as illustrated in FIG. 9, when the paper P having a basis weight of 250 g/m$^2$ or greater is jammed in an area between the nip N and two rollers (for example, the discharge rollers 41,41), the foldings of the paper P are formed up to an area near the midpoint (intersection) between the downstream edge of the nip N and the position where the recording medium (paper P) is nipped between the two rollers (for example, the discharge rollers 41,41) in some cases. Since the paper detection part 111*c* is positioned so as to detect the pressure from a recording medium (paper P) at the midpoint (intersection) between the downstream edge of the nip N and the position where the recording medium (paper P) is nipped between the two rollers (for example, the discharge rollers 41,41), the paper detection part 111*c* is pushed upward near the discharge rollers 41,41 by the foldings of the paper P formed further upstream compared to the foldings formed in paper having a basis weight smaller than 250 g/m$^2$. As a result, the light emitted from the light-emitting part of the photo-interrupter 112 is no longer blocked by the first end 111*b* of the lever 111 and reaches the light-receiving part, allowing the photo-interrupter 112 to output a detection signal. Consequently, the control unit 101 detects the jamming of the paper P.

Figure 10:
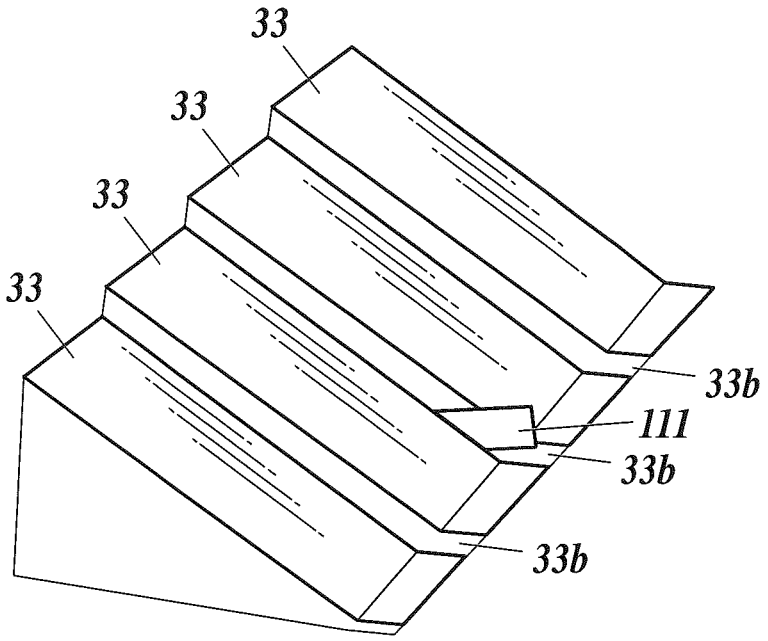
FIG. 10 illustrates the positional relationship between the paper detection part and a separation support nozzle.

For example, as illustrated in FIG. 9, the paper detection part 111*c* of the lever 111 may move upward in the vertical direction and come into contact with another component (for example, the separation support nozzle 33). For example, as illustrated in FIG. 10, vertical slits (for example, slits 33*b* in FIG. 10) may be formed in the component to allow the paper detection part 111*c* to move upward. In this way, the paper detection part 111*c* can move upward without collision with the component.

In this embodiment, the distance between the paper detection part 111*c* and the guide member 42 set based on the data table T is, for example, the smallest distance between the paper detection part 111*c* and the guide member 42, which are disposed substantially parallel to each other. The control unit 101 controls the operation of the actuator 112*a* such that the distance between the paper detection part 111*c* and the guide member 42 is set based on the data table T.

A 100% suction force of the suction fan 31*a*, which is illustrated in FIG. 4, is, for example, equivalent to the operation of the suction fan 31*a* at a maximum static pressure, and 60% and 80% suction forces are determined based on the 100% static pressure. Such percentages are for exemplification purposes and do not limit the scope of the invention. Similarly, the distance between the paper detection part 111*c* and the guide member 42 corresponding to the basis weight of paper, which is illustrated in FIG. 4, is also for exemplification purposes and do not limit the scope of the invention.

As described above, the detection unit (for example, the paper detection part 111*c* of the detection unit 110) of the image forming apparatus 1 according to the first embodiment is disposed at a position in which the distance to the guide member 42 is larger than the distance between the guide member 42 and the conveyed path of a recording medium (paper P) that is urged by the urging unit 30 and passes through a path between the nip N and two rollers (for example, the discharge rollers 41,41). Thus, the image surface of the recording medium fixed by the fixing unit 20 can be prevented from coming into contact with the detection unit when the recording medium is conveyed normally without jamming. In this way, a reduction in image quality due to the image surface contacting and rubbing against other components can be prevented. In other words, the image forming apparatus 1 can output a high-quality image.

Since the urging unit (for example, the urging unit 30 or the depression in the roller 21*a*) that urges a recording medium toward the guide member 42 is disposed between the nip N and the two rollers, the recording medium can be conveyed along the guide member 42, differences in the conveying path of the recording media are reduced, and the distance between the guide member 42 and the conveying path of a recording medium that passes through a path between the nip N and two rollers can be set constant at a small value. That is, although the distance between the detection unit (for example, the paper detection part 111*c* of the detection unit 110) and the guide member 42 is greater than the distance between the guide member 42 and the conveying path of the recording medium that passes through a path between the nip N and two rollers, the detection unit can be disposed such that the distance between the detection unit and the guide member 42 is reduced. In this way, erroneous jamming detection due to the detection unit coming into contact with an unjammed paper can be prevented, and a recording medium jammed in the area between the detection unit and the guide member 42 can be detected quickly.

As described above, quick detection of the jamming in the area between the detection unit and the guide member 42 enables the detection of jamming before the jammed paper damages the fixing device, even when the recording medium is conveyed at high speed (for example, 500 mm/s) by the fixing device and, consequently, the time until the foldings of the jammed paper damage the fixing device is short. Since the fixing device can be stopped upon the detection of jamming, jamming of a recording medium conveyed at high-speed can be detected quickly, high quality images can be formed, and erroneous jamming detection can be reduced.

Since the detection unit (for example, the paper detection part 111*c* of the detection unit 110) detects pressure applied by the recording medium at least at the midpoint (intersection) between the downstream edge of the nip N and the position where the recording medium (paper P) is nipped between two rollers (for example, the discharge rollers 41,41), the unit can detect the pressure applied by the foldings in the recording medium at the midpoint where the recording medium held at both the downstream edge of the nip N and the two rollers is most likely to cause strain when the recording medium is jammed at improved accuracy.

Since the detection unit (for example, the paper detection part 111*c* of the detection unit 110) detects the pressure applied by a recording medium within a predetermined area downstream of the midpoint between the downstream edge of the nip N and the position where the recording medium (paper P) is nipped between two rollers (for example, the discharge rollers 41,41) (for example, the area between the discharge rollers 41,41 and the intersection), the pressure applied by the recording medium jammed in the conveying path between the downstream edge of the nip N and the two rollers as a result of being pushed toward the two rollers disposed downstream can be detected quickly, and the accuracy of jamming detection can be improved.

The magnitude of the urging force applied by the urging unit (for example, the suction fan 31*a* of the urging unit 30) based on the weight per unit area (basis weight) of a recording medium (paper P) is determined with reference to predetermined data (for example, the data table T). The distance between the guide member 42 and the detection unit (for example, the paper detection part 111*c* of the detection unit 110) is then determined based on the weight per unit area (basis weight) of the recording medium (paper P) and the magnitude of the urging force applied by the urging unit. Finally, the control unit 101 controls the operation of the urging unit to apply an urging force of the determined magnitude and controls the operation of the position changing unit (for example, the actuator 112*a*) to set the distance between the guide member 42 and the detection unit to the determined value. In this way, the recording medium is urged toward the guide member 42 with an urging force corresponding to the weight per unit area of the recording medium so as to set a conveying path of the recording medium corresponding to the weight per unit area of the recording medium. At the same time, the distance between the guide member 42 and the detection unit can be controlled in accordance with the conveying path corresponding to the weight per unit area of the recording medium. That is, setting a conveying path corresponding to the weight per unit area of the recording medium and setting the position of the detection unit in accordance with the set conveying path can improve the accuracy of jamming detection.

The control unit 101 detects a jammed recording medium when the detection unit (for example, the paper detection part 111*c* of the detection unit 110) receives a pressure greater than a predetermined value from the recording medium (paper P) continuously for more than a predetermined time. Thus, erroneous jamming detection can be prevented when an unjammed recording medium is conveyed through a conveying path and comes into contact with the detection unit for some reason if the pressure applied by the recording medium coming into contact with the detection unit is less than a predetermined time. In contrast, since a jammed recording medium continues to apply pressure to the detection unit, the control unit 101 can accurately detect the jammed recording medium. That is, the accuracy of jamming detection can be improved by detecting jamming of a recording medium when a pressure greater than a predetermined value is continuously applied by the recording medium for a predetermined time.

Since an air-flow generating unit (for example, the urging unit 30) that generates a flow of air urging a recording medium (paper P) toward the guide member 42 is provided, the recording medium can be urged by the air flow toward the guide member 42, without anything coming into physical contact with the image formation surface of the recording medium. In this way, the image formed on the recording medium is not damaged by the urging unit, and the image forming apparatus 1 outputs a high-quality image.

Among the two rollers forming the nip N (for example, the roller 21*a* and the pressurizing roller 22), the roller adjacent to the guide member 42 (pressurizing roller 22) forms a depression in the circumferential surface of the roller adjacent to the detection unit (roller 21*a*). Since this depression urges the recording medium toward the guide member 42, the recording medium is urged toward the guide member 42 while being conveyed through the nip N. In this way, a conveying path of a recording medium can be aligned to the guide member 42. Additionally, a recording medium can be urged toward the guide member 42 without providing a mechanism dedicated to urging a recording medium toward the guide member 42. Thus, an installation space for the mechanism in the image forming apparatus and additional costs for purchasing such a mechanism are not required. Accordingly, a small image forming apparatus can be provided at a low cost.

Second Embodiment

Figure 11:
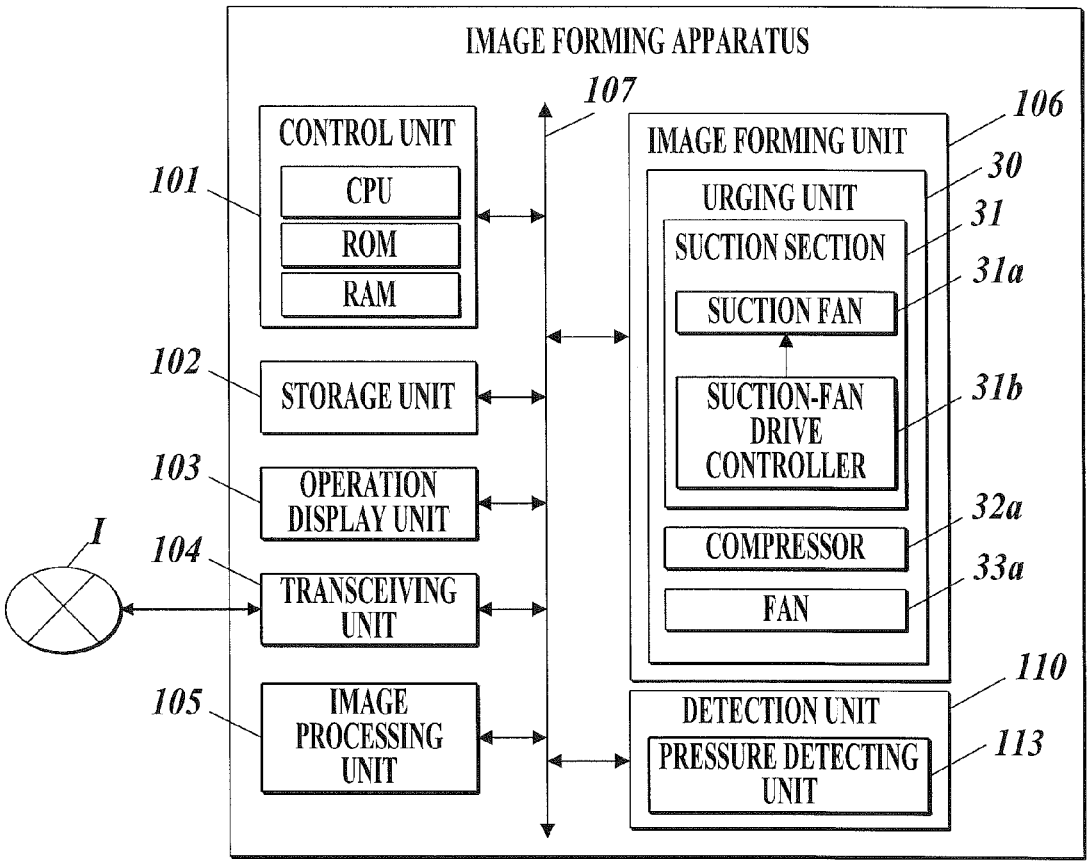
FIG. 11 is a schematic block diagram of an image forming apparatus according to a second embodiment of the present invention.
Figure 12:
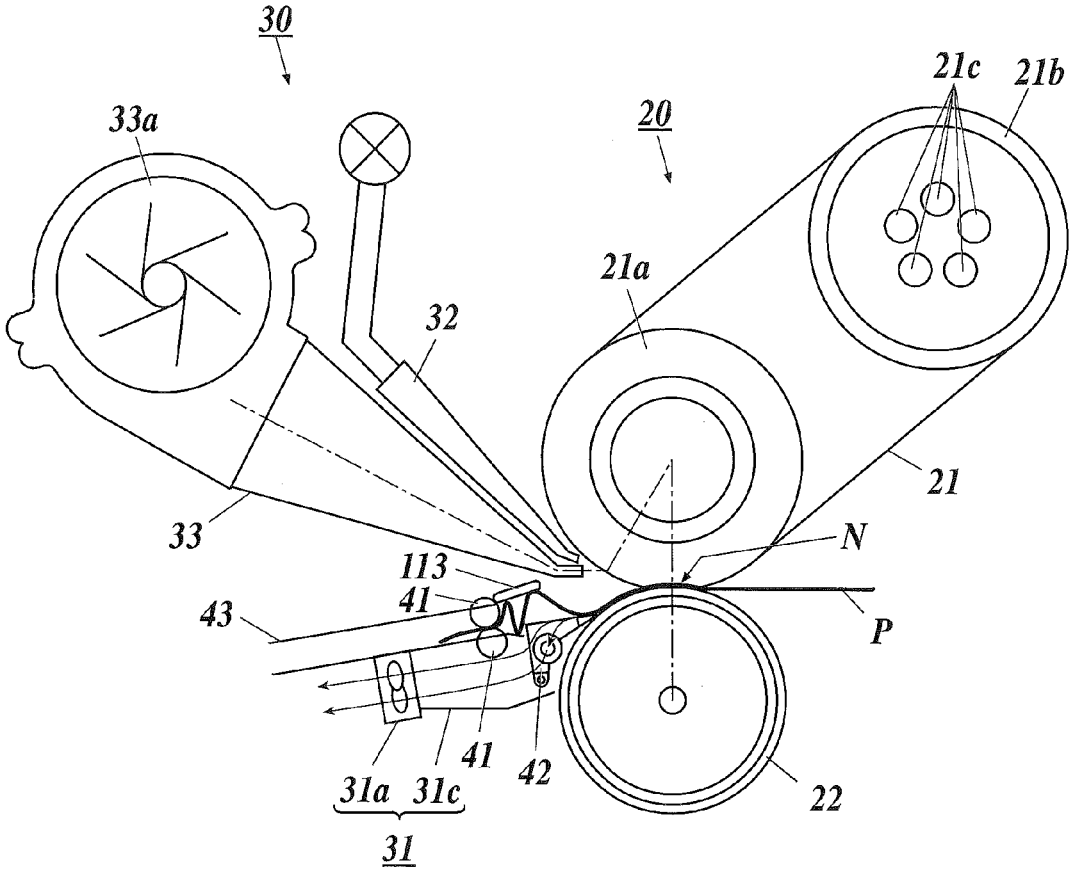
FIG. 12 illustrates an example configuration of a fixing unit, an urging unit, and a detection unit of a fixing device according to the second embodiment.
Figure 14:
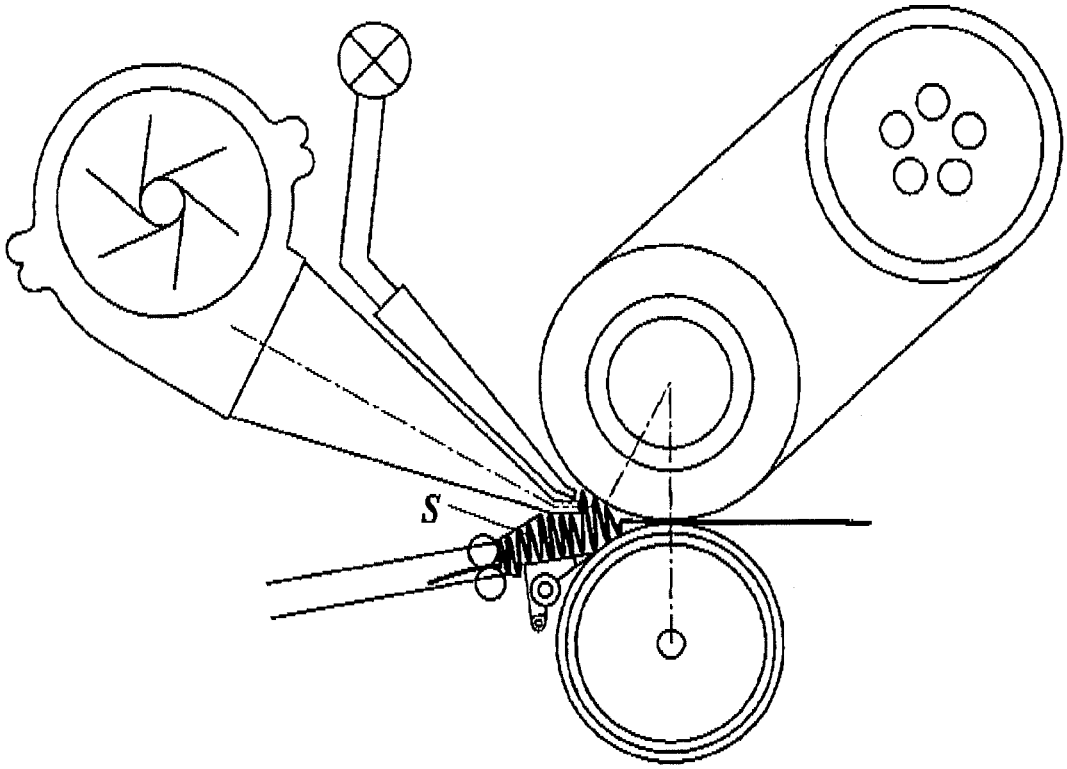
FIG. 14 illustrates jamming of paper in a conventional image forming apparatus.

The second embodiment of the present invention will be described below with reference to FIGS. 11 and 12. The configurations similar to those in the first embodiment are designated by the same reference numerals and duplicated description is omitted.

The detection unit 110 according to the second embodiment includes a pressure detecting unit 113 instead of the lever 111 and the photo-interrupter 112 of the first embodiment.

The pressure detecting unit 113 detects pressure applied by a jammed recording medium (paper P). Specifically, the pressure detecting unit 113 includes a strain gauge that detects mechanical changes in dimension as electric signals.

The pressure detecting unit 113 is disposed at a similar position as the paper detection part 111*c* of the lever 111 of the first embodiment. That is, the pressure detecting unit 113 is disposed substantially parallel to the upper surface of the guide member 42. The pressure detecting unit 113 is positioned such that the distance to the guide member 42 is greater than the distance between the guide member 42 and a conveying path of a recording medium (paper P) being urged by the urging unit 30 and passing through a conveying path between the nip N and two rollers (for example, the discharge rollers 41,41). That is, the pressure detecting unit 113 is positioned such that it does not come into contact with the unjammed paper P passing between the nip N and the discharge rollers 41,41.

Specifically, the pressure detecting unit 113 is attached to the upper surface of an upper guide plate 43, which is disposed substantially parallel to the upper surface of the guide member 42 at a position opposite to the guide member 42 across the conveying path of the paper P.

When the upper guide plate 43 comes into contact with a jammed recording medium (paper P), the upper guide plate 43 receives pressure from the recording medium and warps. An electric signal generated by this warpage is detected by the pressure detecting unit 113. The pressure detecting unit 113 outputs a detection signal corresponding to the detected electric signal. The control unit 101 of the second embodiment detects jamming of the paper P on the basis of a detection signal output from the pressure detecting unit 113. The detection mechanism is similar to that of the first embodiment in which a detection signal is output from the photo-interrupter 112.

The image forming apparatus 1 according to the second embodiment has the same configuration as the image forming apparatus 1 according to the first embodiment, except that the detection unit 110 is provided with a pressure detecting unit 113 in place of the lever 111 and the photo-interrupter 112.

For example, the control unit 101 of the second embodiment applies, to the pressure detecting unit 113, the same mechanism of detecting jamming of a recording medium when a pressure greater than a predetermined value is received by the paper detection part 111*c* from the recording medium (paper P) continuously for a predetermined time (for example, 100 ms). For example, the control unit 101 determines that a recording medium has jammed when the pressure detecting unit 113 generates a detection signal based on an electric signal corresponding to warpage greater than a predetermined value for more than a predetermined time.

Since the pressure detecting unit 113 of the image forming apparatus 1 according to the second embodiment detects pressure applied by a recording medium that comes into contact with the pressure detecting unit 113, pressure applied by the jammed recording medium can be detected without relying on a mechanical movement. Thus, highly accurate jamming detection can be performed with a small detection unit.

The embodiments described above of the present invention should be for the purposes of illustration and not limitation.

The present invention is not limitedly applied to the above-described embodiments, and appropriate modifications or alterations of the invention can be made within the scope without departing from the spirit of the invention.

For example, a plurality of detection units may be disposed along the width direction of a recording medium (paper P), which is a direction orthogonal to the conveying direction. Specifically, for example, a plurality of levers 111 and a plurality of photo-interrupters 112 according to the first embodiment may be disposed at predetermined intervals along the width direction, within a range corresponding to the width of a recording medium having a greatest length in the width direction, which is a direction orthogonal to the conveying direction, among various recording media that can be used as the paper P for the image forming apparatus 1.

A plurality of detection units (for example, levers 111 and photo-interrupters 112) provided along the width direction, orthogonal to the conveying direction, of the recording medium (paper P) can quickly detect jamming in the form of a pressure applied by the recording medium by at least one of the detection units even if the start point of a jammed recording medium varies in the width direction.

The urging force by the urging unit based on the weight per unit area of a recording medium and the distance between the detection unit and the guide member 42 based on the urging force by the urging unit based on the weight per unit area of the recording medium are not limited to those set in accordance with the data table T in the first embodiment.

FIG. 13 illustrates a data table T2 that contains correspondence data of the basis weight of paper, the magnitude of the suction force of the suction fan 31*a*, the magnitude of the urging forces of the separation support nozzles 32 and 33, and the distance between the paper detection part 111*c* and the guide member 42.

In the data table T2, the magnitude of the suction force of the suction fan 31*a* and the magnitude of the urging forces of the separation support nozzles 32 and 33 are 100% when the basis weight of paper is 80 g/m$^2$ or smaller. For a recording medium that is thin and light, such as paper having a basis weight of paper is 80 g/m$^2$ or smaller, the paper wobbles against the guide member 42 causing fluctuation in the conveying path. Thus, the setting in the data table T2 provides sufficient urging of the recording medium toward the guide member 42 by the components of the urging unit 30.

For paper having a basis weight greater than 80 g/m$^2$ and smaller than 130 g/m$^2$, a recording medium is less likely to wobble against the guide member 42 compared with paper having a basis weight of 80 g/m$^2$ or smaller. Thus, the magnitude of the suction force of the suction fan 31*a* and the magnitude of the urging forces of the separation support nozzles 32 and 33 are set relatively small, i.e., 80%, in the data table T2.

For paper having a basis weight of 130 g/m$^2$ or greater, both the magnitude of the suction force of the suction fan 31*a* and the magnitude of the urging forces of the separation support nozzles 32 and 33 are set to 0%, in the data table T2. That is, according to the data table T2, a recording medium is not urged by the suction fan 31*a* and the separation support nozzles 32 and 33 for paper having a basis weight of 130 g/m$^2$ or greater for the following reason. It is presumed that a recording medium having a basis weight of 130 g/m$^2$ or greater has a stiffness sufficient for the recording medium to be separated from the fixing belt 21 and pressurizing roller 22 of the fixing unit 20 by simply urging the recording medium toward the guide member 42 with the depression of the fixing unit 20 and to move along the guide member 42.

The settings of the present invention is not limited to the data tables T and T2, and various different settings may be used for the magnitude of the urging force based on the weight per unit area of a recording medium applied by the urging unit and the distance between the guide member 42 and the detection unit based on the weight per unit area of the recording medium and the urging force applied by the urging unit.

In the first embodiment, the magnitude of the urging force based on the weight per unit area of a recording medium applied by the urging unit and the distance between the guide member 42 and the detection unit based on the weight per unit area of the recording medium and the urging force applied by the urging unit are determined based on predetermined data. However, the predetermined data is merely an example and does not limit the scope of the invention. For example, the control unit 101 may determine the magnitude of the urging force and the distance between the guide member 42 and the detection unit based on an instruction input by the user, or otherwise, the magnitude of the urging force and the distance between the guide member 42 and the detection unit determined based on an input may be stored in the storage unit 102.

In the first embodiment, the magnitude of the urging force applied by the urging unit (for example, the suction fan 31*a* of the urging unit 30) based on the weight per unit area (basis weight) of a recording medium (paper P) is determined according to predetermined data (for example, data table T), and the distance between the guide member 42 and the detection unit (for example, the paper detection part 111*c* of the detection unit 110) is determined based on the weight per unit area (basis weight) of the recording medium (paper P) and the magnitude of the urging force applied by the urging unit. Instead, the distance between the guide member 42 and the detection unit may be determined based on the weight per unit area of the recording medium, without determining the magnitude of the urging force applied by the urging unit.

In such a case, the control associated with the weight per unit area of the recording medium is simplified because the magnitude of the urging force applied by the urging unit based on the weight per unit area of the recording medium is unnecessary. Furthermore, the position of the detection unit can be set in accordance with the conveying path corresponding to the weight per unit area of the recording medium because the distance between the guide member 42 and the detection unit is set in accordance with the weight per unit area of the recording medium. Thus, the accuracy of jamming detection can be improved.

The configurations of urging units of the embodiments are merely examples and do not limit the scope of the invention. For example, the image forming apparatus may include only the suction section 31 as an urging unit or may include the separation support nozzles 32 and 33 to urge the paper P toward the guide member 42 by applying air, in addition to the suction section 31, to urge the paper P.

The paper detection part 111*c* of the lever 111 extends along the entire length from the intersection to the area near the discharge rollers 41,41. This configuration is merely an example and does not limit the scope of the invention.

The detection unit (for example, the paper detection part 111*c* of the lever 111 and the pressure detecting unit 113) is desirably positioned such that jamming of a recording medium (paper P) can be detected at, at least, the midpoint between the downstream edge of the nip N in the conveying direction and the position where the recording medium is nipped between the two rollers (for example, the discharge rollers 41,41).

The image formation according to the embodiments is color printing in which a toner image of four different colors is transferred onto paper P. Such color printing is merely an example of image formation and does not limit the scope of the invention. For example, the image forming apparatus 1 may perform monochrome printing in which a single color toner image (for example, a black (K) toner image) is transferred onto the paper P.

The process of image formation on paper P has been described above. The image forming apparatus 1 can also form images on recording media other than paper using the same mechanism as that used for image formation on paper.

The image forming unit 106 includes four electrostatic drums that transfer four colors, i.e., yellow (Y), magenta (M), cyan (C), and black (K) (tandem printing). This configuration is merely an example and does not limit the scope of the invention. For example, the image forming unit 106 may include only one electrostatic drum.

According to an aspect of the preferred embodiments of the present invention, there is provided a fixing device including:

a fixing unit that has a nip conveying a recording medium while fixing an image to the recording medium by pressure and heat applied to the recording medium;

two rollers that are disposed downstream of the nip in a conveying direction of the recording medium and cooperating with each other to convey the recording medium discharged from the nip;

a guide member that is disposed between the nip and the two rollers, faces a first side of the recording medium, the first side having no recorded image, and guides the recording medium through a conveying path;

a detection unit that is disposed substantially parallel to the guide member opposite to the guide member across the recording medium conveyed between the nip and the two rollers, the detection unit detecting jamming of the recording medium on the basis of a pressure greater than a predetermined value applied by the recording medium between the nip and the two rollers; and an urging unit that urges the recording medium toward the guide member between the nip and the two rollers, wherein the distance between the nip and the two rollers is smaller than the length of the recording medium along the conveying direction, and the distance between the guide member and the detection unit is greater than the distance between the guide member and the recording medium passing between the nip and the two rollers while being urged by the urging unit.

According to an aspect of the preferred embodiments of the present invention, there is provided an image forming apparatus including:

an image forming unit that forms an image on a recording medium; and the fixing device.

Consequently, a fixing device and an image forming apparatus that quickly detect jamming of a recording medium conveyed at a high speed, maintains high image quality, and reduces erroneous detection of jamming of a recording medium can be provided.

Preferably, in the fixing device, the detection unit detects jamming of the recording medium at, at least, the midpoint between the downstream edge of the nip in the conveying direction and the position where the recording medium is nipped between the two rollers.

Preferably, in the fixing device, the detection unit detects jamming of the recording medium within a predetermined area downstream of the midpoint in the conveying direction.

Preferably, the fixing device further includes:

a position changing unit that changes the position of the detection unit with respect to the guide member;

a distance determining unit that determines the distance between the guide member and the detection unit based on the weight per unit area of the recording medium; and a position control unit that controls the operation of the position changing unit such that the distance between the guide member and the detection unit is set to the distance determined by the distance determining unit.

Preferably, the fixing device, further includes:

an urging-force determining unit that determines the magnitude of an urging force applied by the urging unit based on the weight per unit area of the recording medium; and an urging control unit that controls the operation of the urging unit such that the magnitude of the urging force is set to the magnitude determined by the urging-force determining unit, wherein the distance determining unit determines the distance between the guide member and the detection unit based on the weight per unit area of the recording medium and the magnitude of the urging force to be applied by the urging unit determined by the urging-force determining unit.

Preferably, in the fixing device, the detection unit includes a pressure detecting unit that detects pressure applied by the recording medium.

Preferably, in the fixing device, the detection unit determines jamming of the recording medium when the detection unit continuously detects a pressure greater than a predetermined value applied by the recording medium for a predetermined time.

Preferably, in the fixing device, a plurality of the detection units is disposed along the width direction of the recording medium in a direction orthogonal with the conveying direction.

Preferably, in the fixing device, the urging unit includes an air-flow generating unit that generates an air flow urging the recording medium toward the guide member.

Preferably, in the fixing device, the nip is provided between paired second rollers, one of the second rollers disposed adjacent to the guide member forms a depression in the circumferential surface of the other second roller disposed adjacent to the detection unit, and the depression constitutes an urging unit.

The present application is based on Japanese Patent Application No. 2011-103375 filed on May 6, 2011 to the Japanese Patent Office, which shall be a basis for correcting mistranslations.

What is claimed is:

1. A fixing device comprising:

a fixing unit that has a nip conveying a recording medium while fixing an image to the recording medium by pressure and heat applied to the recording medium;

two rollers that are disposed downstream of the nip in a conveying direction of the recording medium and cooperating with each other to convey the recording medium discharged from the nip;

a guide member that is disposed between the nip and the two rollers, faces a first side of the recording medium, the first side having no recorded image, and guides the recording medium through a conveying path;

a detection unit that is disposed substantially parallel to the guide member opposite to the guide member across the recording medium conveyed between the nip and the two rollers, the detection unit detecting jamming of the recording medium on the basis of a pressure greater than a predetermined value applied by the recording medium between the nip and the two rollers;

an urging unit that urges the recording medium toward the guide member between the nip and the two rollers, a position changing unit that changes the position of the detection unit with respect to the guide member;

a distance determining unit that determines the distance between the guide member and the detection unit based on the weight per unit area of the recording medium;

a position control unit that controls the operation of the position changing unit such that the distance between the guide member and the detection unit is set to the distance determined by the distance determining unit;

an urging-force determining unit that determines the magnitude of an urging force applied by the urging unit based on the weight per unit area of the recording medium; and an urging control unit that controls the operation of the urging unit such that the magnitude of the urging force is set to the magnitude determined by the urging-force determining unit;

wherein the distance between the nip and the two rollers is smaller than the length of the recording medium along the conveying direction, the distance between the guide member and the detection unit is greater than the distance between the guide member and the recording medium passing between the nip and the two rollers while being urged by the urging unit, and the distance determining unit determines the distance between the guide member and the detection unit based on the weight per unit area of the recording medium and the magnitude of the urging force to be applied by the urging unit determined by the urging-force determining unit.

2. The fixing device of claim 1, wherein the detection unit detects jamming of the recording medium at, at least, the midpoint between the downstream edge of the nip in the conveying direction and the position where the recording medium is nipped between the two rollers.

3. The fixing device of claim 2, wherein the detection unit detects jamming of the recording medium within a predetermined area downstream of the midpoint in the conveying direction.

4. The fixing device of claim 1, wherein the detection unit includes a pressure detecting unit that detects pressure applied by the recording medium.

5. The fixing device of claim 1, wherein the detection unit determines jamming of the recording medium when the detection unit continuously detects a pressure greater than a predetermined value applied by the recording medium for a predetermined time.

6. The fixing device of claim 1, wherein a plurality of the detection units is disposed along the width direction of the recording medium in a direction orthogonal with the conveying direction.

7. The fixing device of claim 1, wherein the urging unit includes an air-flow generating unit that generates an air flow urging the recording medium toward the guide member.

8. The fixing device of claim 1, wherein the nip is provided between paired second rollers, one of the second rollers disposed adjacent to the guide member forms a depression in the circumferential surface of the other second roller disposed adjacent to the detection unit, and the depression constitutes an urging unit.

9. An image forming apparatus comprising:

an image forming unit that forms an image on a recording medium; and the fixing device according to claim 1.

10. The fixing device of claim 1, wherein a hole is provided in the guide member, and the urging unit is disposed between the nip and two rollers on a side of the guide member opposite of the recording medium so as to urge the recording medium toward the guide member.

* * * * *